United States Patent [19]

Lang

[11] 4,175,686

[45] Nov. 27, 1979

[54] DEVICE FOR STRIPPING BLANKS FROM A DIE CUT SHEET OF BLANKS

[75] Inventor: Pierre Lang, Ecublens, Switzerland

[73] Assignee: J. Bobst & Fils, S.A., Lausanne, Switzerland

[21] Appl. No.: 909,034

[22] Filed: May 24, 1978

[30] Foreign Application Priority Data

May 26, 1977 [CH] Switzerland ..... 6478/77

[51] Int. Cl.[2] ..... B26F 3/02

[52] U.S. Cl. ..... 225/97; 83/103; 83/696; 93/36 A; 225/103

[58] Field of Search ..... 225/97, 103; 93/36 A; 83/103, 696

[56] References Cited

U.S. PATENT DOCUMENTS

| | | | |
|---|---|---|---|
| 1,787,815 | 1/1931 | Ditchfield | 83/696 X |
| 2,845,011 | 7/1958 | Schilling | 93/36 A |
| 3,055,275 | 9/1962 | Schroter | 93/36 A |
| 3,249,272 | 5/1966 | Scarpa | 93/36 A X |

*Primary Examiner*—Frank T. Yost

*Attorney, Agent, or Firm*—Hill, Van Santen, Steadman, Chiara & Simpson

[57] ABSTRACT

In a device for stripping blanks from a die cut sheet of blanks including a set of punches mounted on a movable upper punch frame and a matrix having openings corresponding to the outlines of both the punches and blank on a lower frame characterized by each of the punches comprising a plurality of punch members and means extending between adjacent punch members to close the outline of the punch with the punch members being adjustably mounted on a first set of bars which are slidably mounted on the punch frame and the matrix being formed by two pairs of parallel extending bars or members which are slidably mounted on the frame of the matrix to vary the size of the openings therein.

7 Claims, 9 Drawing Figures

23
24
25
26
27
28
29
30
31
32
33
34
35
36
37
38
39
40
41
42
43
44
46
47
52

DEVICE FOR STRIPPING BLANKS FROM A DIE CUT SHEET OF BLANKS

BACKGROUND OF THE INVENTION

1. Field of the Invention

The present invention is directed to a device for stripping blanks from a die cut sheet of blanks, which device includes an upper movable set of punches and a lower stationary matrix.

2. Prior Art

Stripping tools or devices designed to separate various blanks from a previously die-cut sheet of blanks from each other generally consist of an upper movable punch and a lower fixed matrix. The sheet of blanks are usually formed by a press, for example by a platen press with the blanks being interconnected together by nicks and also connected by nicks to a peripheral waste area. When the blanks are stripped from the sheet, the upper movable punch pushes each of the blanks through openings in the lower matrix, which causes a rupture of the various interconnecting nicks that extend between the blanks and between the blanks and the outer peripheral waste area.

In previously known devices, the punches have been made to conform to the outline of the blank to be stripped and the punches can be made of synthetic resin or wood. Since the sheet of blank, which is to be stripped, has considerable dimensions, it is conspicuous that several punches may be required to be used simultaneously. The punches are aligned with the die cutting tool of the press and secured on a base plate or punch frame which itself is held within an upper tool carrier frame of the stripping station of the press. Opposite each punch, a lower matrix, which has a size of the sheet and has a plurality of openings, which conform to the outline of the blanks, which are to be stripped from the sheet, is mounted. The matrix consists of small bars of reinforced synthetic material, which are arranged in a way that they cross one another to form a grid, which has a mesh with openings of about the same dimension as the blanks that are to be stripped from the sheet.

Since the stripping tool or device of this type can be used only for a given blank size, it involves a relatively high cost. Each time another job is to be undertaken, for example, with a change of the size or shape of the blanks, a new punch and also a new matrix must be prepared and installed in the press.

SUMMARY OF THE INVENTION

The present invention is directed to provide a device for stripping blanks from a die cut sheet of blanks, which device can be used to strip blanks of various sizes and dimensions.

To accomplish these tasks, the invention is directed to an improvement in a device for stripping blanks from a die cut sheet of blanks, said device including a set of punches mounted on a punch frame and a matrix being supported on a support frame and having openings corresponding to the outlines of both the punches and the blanks, one of the frames being movable to the other so that the punches can extend into the openings of the matrix to force the blanks through the matrix openings to strip them from the sheets. The improvements comprise each of the punches of the set of punches comprising a plurality of punch members and means extending between adjacent punch members to close the outline of each punch, said punch members being adjustably mounted on a first set of bars supported on the punch frame and slidable therealong to vary the size of the outline of each punch, said matrix comprising a first set of parallel extending members, a second set of parallel extending members and a plurality of removable fastening means for interconnecting, said support frame being rectangular with one set of parallel sides being at one level and the second set of parallel sides being at a different level, said first set of parallel extending members being adjustably mounted on said first set of parallel sides and shifted therealong to adjust the distance therebetween, said second set of parallel extending members being adjustably mounted on said second set of parallel sides to overlie and extend across the first set and being shiftable therealong to adjust the distance therebetween so that the size of the rectangular opening formed by adjacent parallel members of the first and second sets is adjustable, said removable fastening means being disposed at each cross over point between the first and second set of members for interconnecting the members together.

DESCRIPTION OF THE PREFERRED EMBODIMENTS

The principles of the present invention are particularly useful for separating individual blanks 53 (FIG. 4) from a sheet 50 of blanks.

Figure 1:
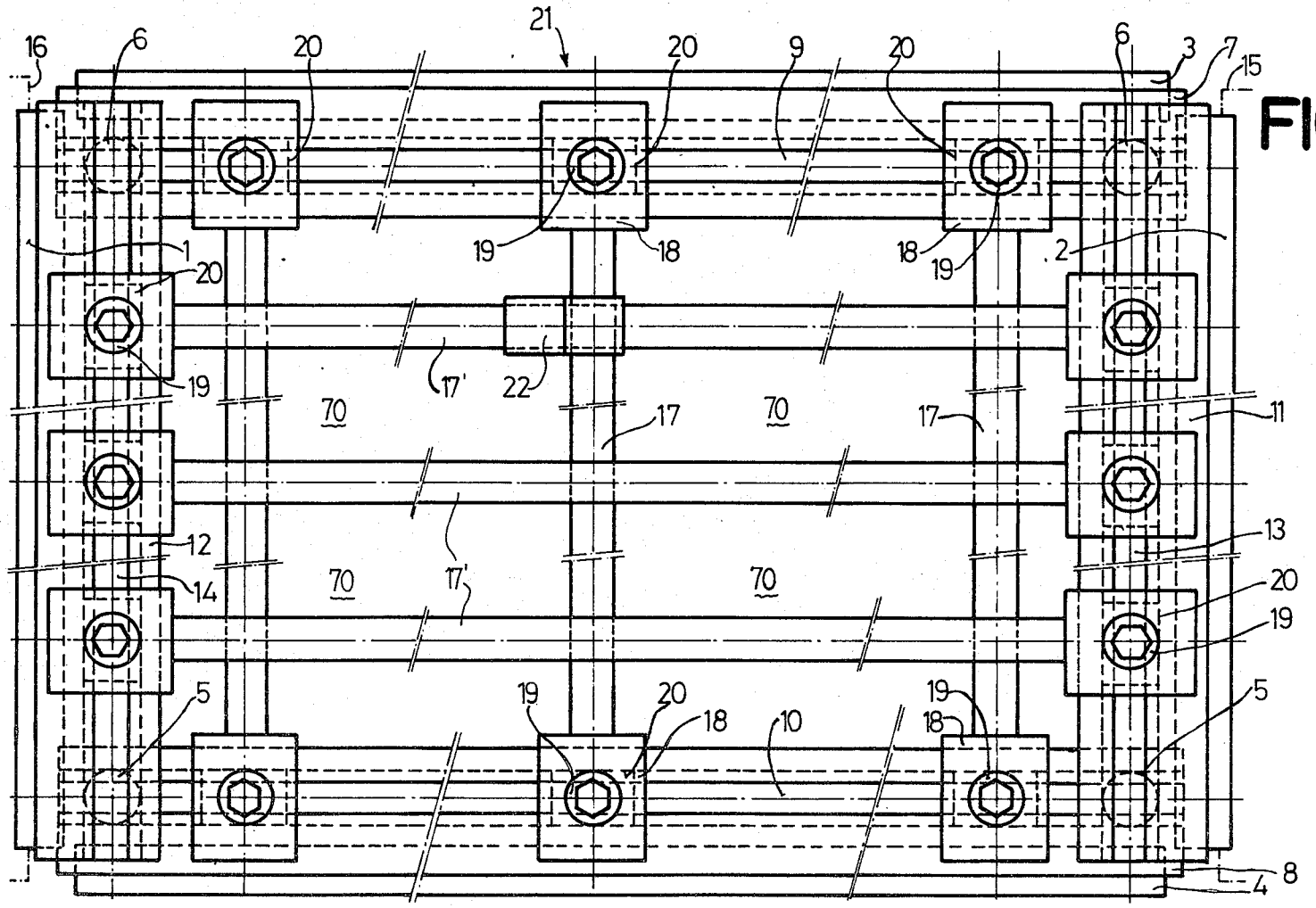
FIG. 1 is a top plan view of the lower support frame of a stripping station equipped with an adjustable matrix in accordance with the present invention.

The device includes a matrix generally indicated at 21 in FIG. 1 which has a support frame that includes two longitudinal beams 1 and 2 that are interconnected to one another by parallel extending cross bars or members 3 and 4. The longitudinal beams 1 and 2 as well as the cross bars 3 and 4 are assembled together by fastening means such as machine screws which are not illustrated. The cross bar 3 supports a sliding rail 7 which is secured thereto by machine screws 6 and cross bar 4 supports a sliding rail 8 which is attached by screws 5. The rails 7 and 8 are provided with dovetail grooves 9 and 10, respectively. A pair of sliding rails 11 and 12 which are also provided with dovetail grooves 13 and 14 are secured on the sliding rails 7 and 8 by means which are not represented and extend perpendicular to the rails 7 and 8. The frame, which is made up of the members 1–4, rails 7 and 8 and rails 11 and 12, is supported by slide members 15 and 16 (represented in dot-dash lines) of a machine or press frame.

To form a matrix 21 with a mask 48 (FIG. 3) with various openings 70, a plurality of longitudinally extending members 17, which are preferably cylindrical bars are provided. Each of the cylindrical bars 17, which may also have a rectangular cross section, are provided with fastening members 18 with each member 18 having an L-shaped with one portion supporting a screw 19 extending into a wedged-shaped nut 20 for securing the end member 18 in one of the slots such as 9 of the rail 7. As illustrated, one set of bars or members 17 extends parallel between the rails 7 and 8 while a second set member 17′ extends between the rail, 11 and 12 and thus perpendicular to the first mentioned set. It should be noted that since the rails 11 and 12 are mounted on the rails 7 and 8, they are at a different and elevated level thereabove. Thus, the first set of members 17 which extend between the rails 7 and 8 are at a different level than the second set 17′ to extend between the rails 11 and 12 and the set 17′ overlies the first set and crosses thereover. While the matrix 21 of FIG. 1 only illustrates three members in each set, it is possible to secure as many members 17 on the sliding rails 7 and 8 or 11 and 12 as may be desired.

Figure 3:
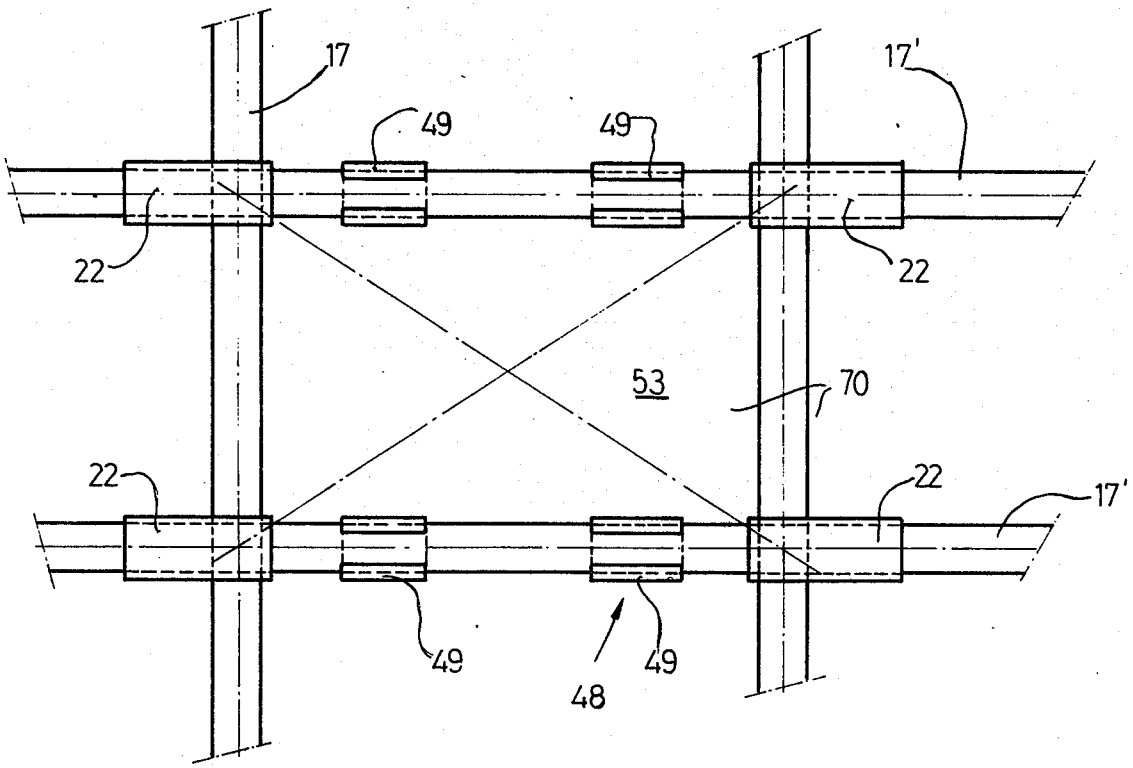
FIG. 3 is a detailed top view of part of the lower matrix of FIG. 1.

In order to interconnect the bars or member 17 of one set of the bars or member 17′ of the other set, a plurality of removable fastening means such as a fastening rider or clip 22 are provided. For the purposes of illustration, only one fastening means 22 is illustrated in FIG. 1; however, one clip or fastening means is preferably provided at each cross over point or point of interconnection as illustrated in FIG. 3. A detailed description of the structure of the removable fastening means is disclosed hereinafter.

Figure 2:
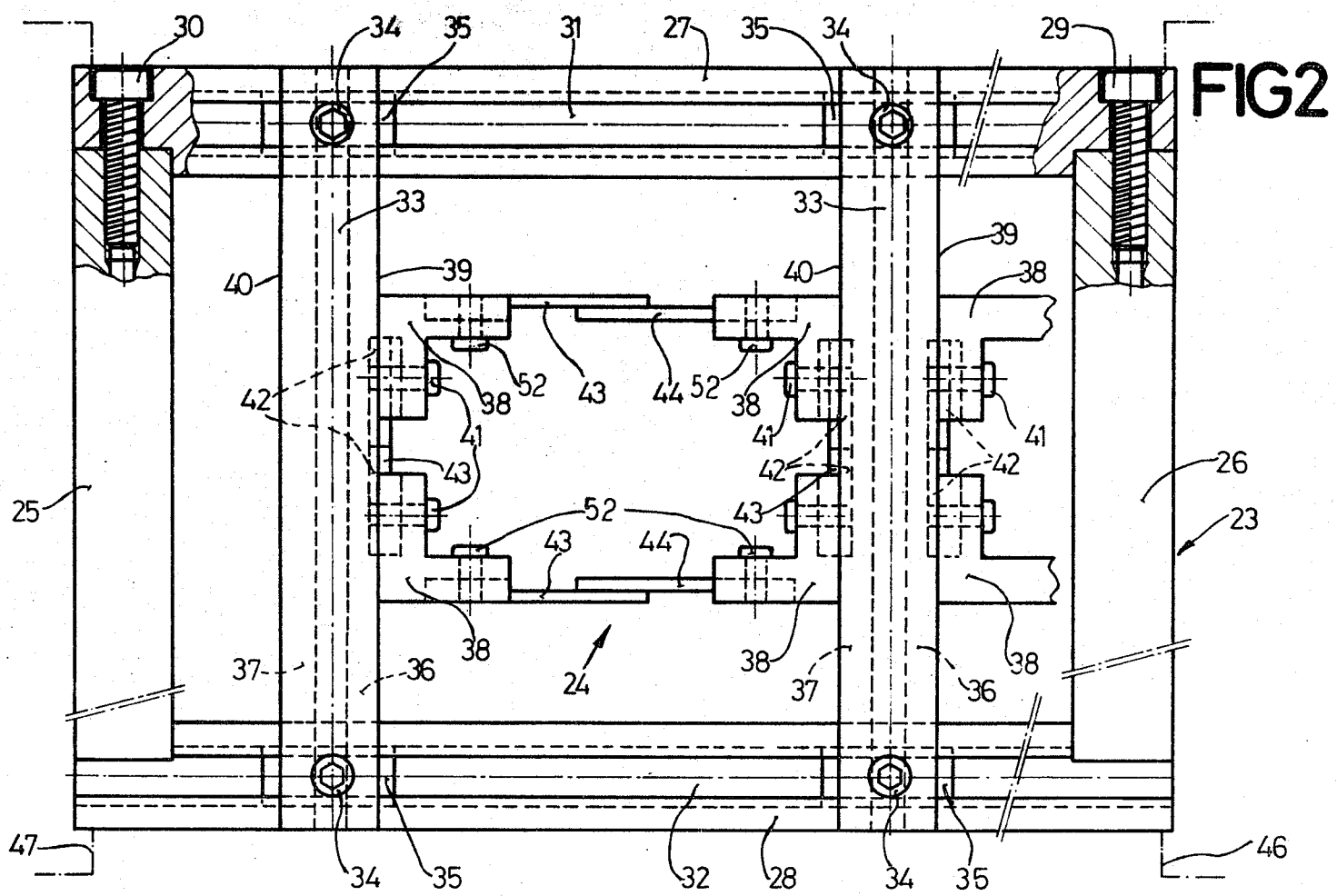
FIG. 2 is a top plan view of the upper movable frame represented with a punch in accordance with the present invention.

In accordance with the present invention, a set of punches generally indicated at 24 in FIG. 2 are mounted on a movable frame generally indicated at 23 in FIG. 2. The frame 23 consists of two longitudinal beams 25 and 26 which extend parallel and are interconnected by a pair of parallel cross bars or members 27 and 28, which have dovetial grooves 31 and 32, respectively, by suitable fastening means such as machine screws 29 and 30. The frame 23 is mounted for sliding movement in the stripping station on sliding rails or guide members 46 and 47, which are illustrated in dot-dash lines and are part of the machine frame or press frame.

Figure 4:
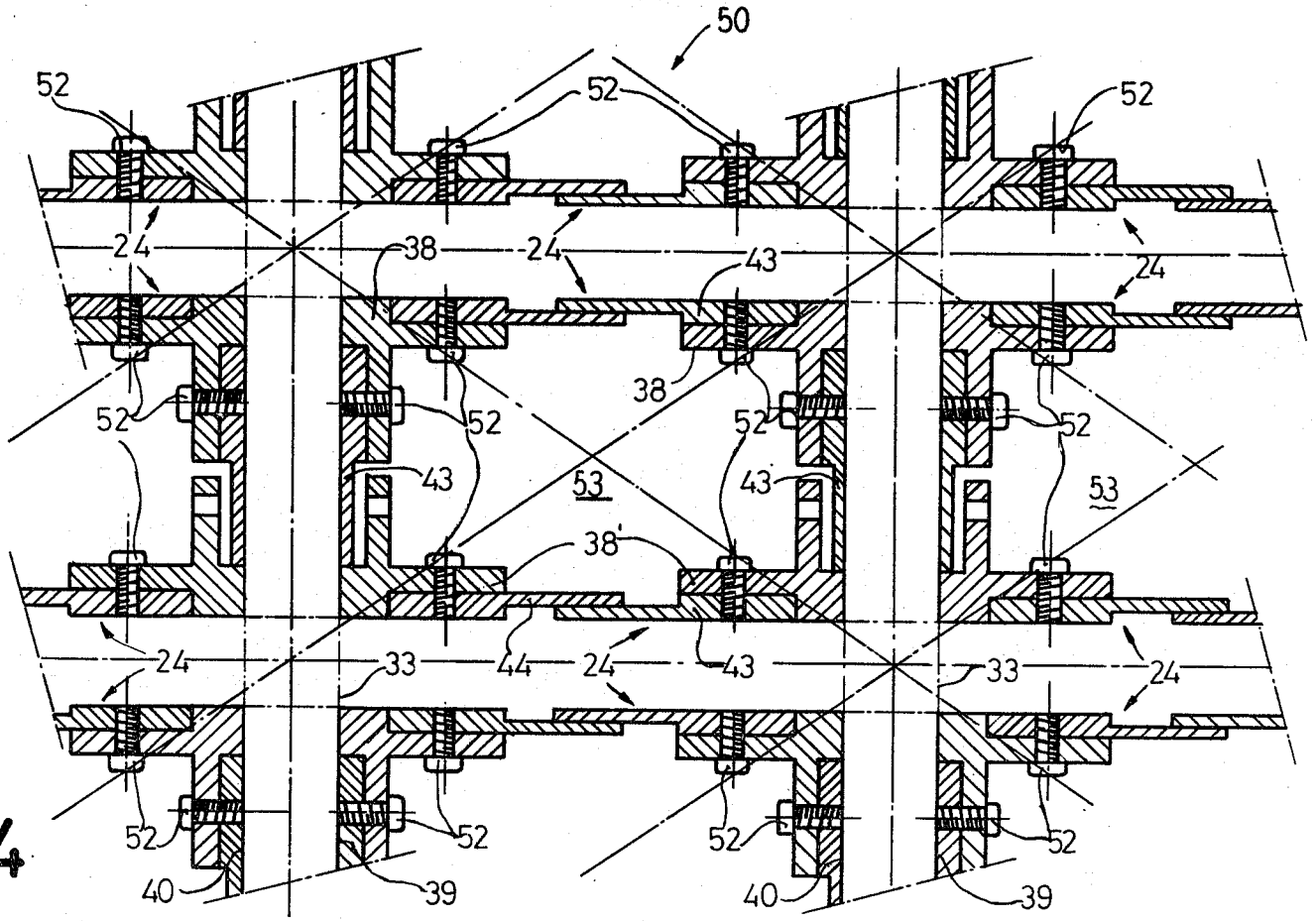
FIG. 4 is a cross-sectional view with portions in elevation of a group of punches taken on lines IV—IV of FIG. 5.

A plurality of parallel extending members 33 are secured on the cross members 27 and 28. Each of the members 33 is provided with a fastener such as a screw 34 which receives a wedge-shaped nut 35. To fastening the members 33 on the cross members 27 and 28, the nuts 35 are received in the respective grooves 31 and 32 of the members 27 and 28. Each of the members 33 on each side is provided with dovetail grooves 36 and 37. A plurality of punch members 38 are secured on facing sides such as 39 and 40 of the members 33 by means of screws 41 and wedge-shaped nuts 42 (but illustrated in FIG. 5). Each of the punch members 38, which is illustrated in FIG. 2, has a right angle shape and has been milled adjacent a lower edge so as to enable the reception of plates 43 or 44, which form interconnecting or linking members that form means for extending between adjacent punch members 38 to close or complete the outline of the punch 24. The members 43 and 44 may be secured to their respective punch member 38 by a fastening means such as screw 52. The plates or members 43 and 44 may be machined in such a manner that their ends may overlap as best illustrated in FIG. 4. Thus, the size and dimension or shape of the rectangular punch 24 such as illustrated in FIG. 2 may be changed by changing the distance between the parallel members 33, 33 and by changing the position of the punch members 38 on each of the parallel members 33.

As best illustrated in FIG. 3, the mesh 48 which is formed by the two sets of longitudinally extending members 17 and 17′ are adjusted to have openings such as 70 which are approximately the same size as the dimensions of a blank 53. It should be noted that the members forming the sets 17, 17′ are disposed at the same distance as the edges of the blank 53. Also, it is noted that blank guides 49 have been applied to the members of one set 17′ to guide a blank after it has been forced through the opening 70 in the mesh 48.

In FIG. 4, the relationship of the various punches 24 to the blanks 53 of the sheet 50 of blanks is illustrated. As in FIGS. 3 and 4, the blanks 53 are illustrated and defined by chain lines. The various members 33 are arranged with their center lines lying spaced apart the same distance as the length of the blanks 53 so that the punch members 38 will be disposed adjacent the corners of the blanks and slightly inward thereof. Since the blanks 53 are substantially narrower than their length, one punch member 38′ adjacent each member 33 does not have a plate 44 to extend parallel to side 39 or 40. However, each of the punch members 38 and 38′ on a portion which extends parallel to the length of the blank 53 have both the plates 43 and 44 so that the entire outline of the punch is completed. It should be noted, if the blank is larger particularly in the direction extending parallel to the members 33, a plate such as 44 can be provided if necessary to close the outline of the punch.

As illustrated, the position of the bars 33 is selected so that the center lines are approximately beneath the edges of the blanks 53. Thus, each of the punch members 38 is positioned adjacent an edge but slightly disposed inward thereof, and the surface area of the outline of the punch 24 is generally smaller than the area of the opening 70 in the mesh 48 (see FIG. 3). The distance between the axis of the members 17 of the mesh 48 on either side of the outline of the punch 24 will vary between 20 and 60 mm. This distance is selected to be dependent on the weight of the board of the blank so that necessary bending of the blank to force it through an opening 70 can occur.

Figure 5:
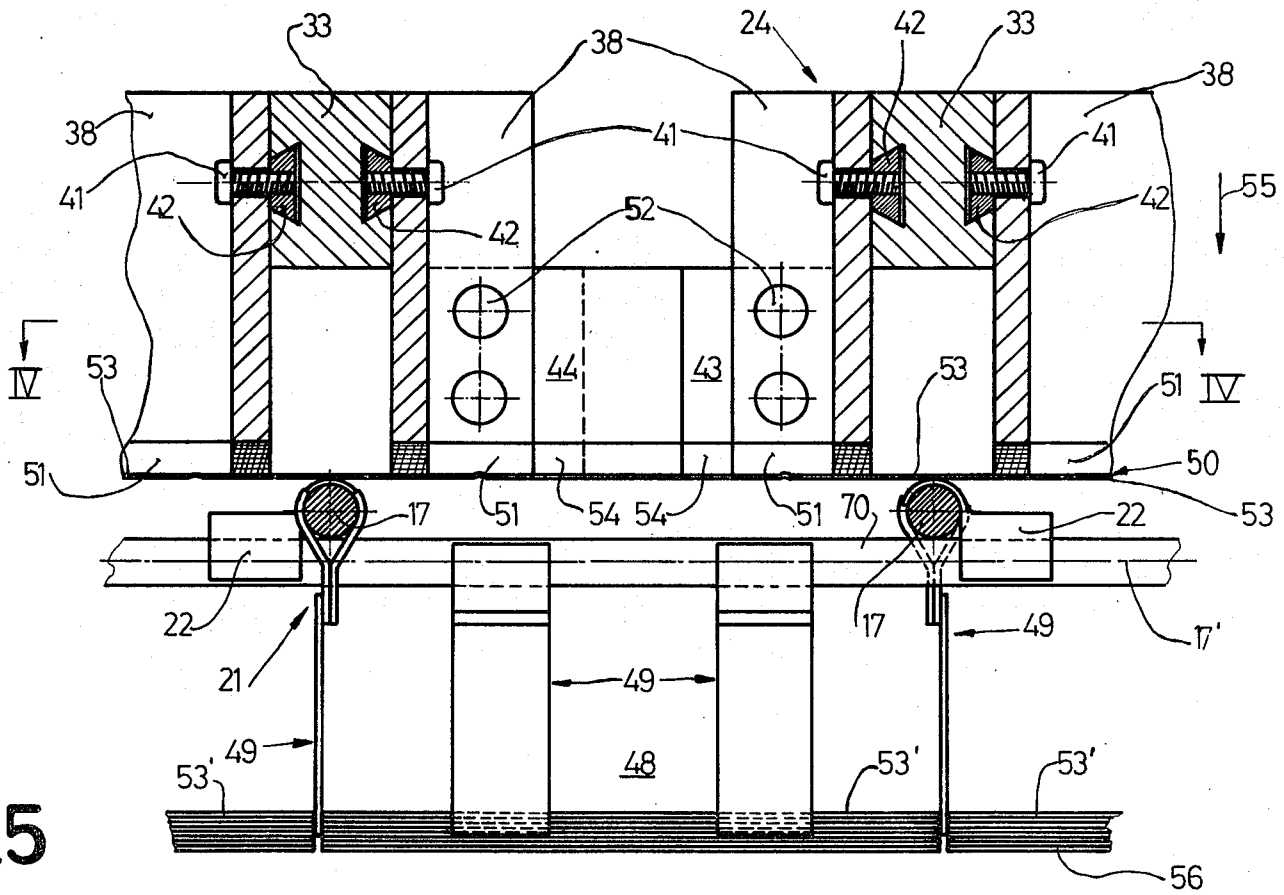
FIG. 5 is a cross-sectional repesentation of a punch and opening of a matrix in accordance with the present invention.

As best illustrated in FIG. 5, the blanks 53 of the sheet 50 is interposed between the mesh 48 formed by the two sets of the members 17 and the punch 24, which is formed by the punch members 38 as well as various plate members such as 43 and 44. As illustrated, the bottom edge of each of the punch members 38 is provided with a rubber coating or pad 51 and each of the plate members 43 and 44 are also provided with rubber coating or pads 54. Thus, the punch can exert pressure on the blank 50 without crushing or marring the material of the blank.

As illustrated, the opening formed by the bars 17 is such that the axis of the bars 17 are approximately the same distance as the size of the blank 53. During a stripping action, the upper movable frame 23 moves in the direction of arrow 55 whereupon a blank 53 will be engaged by the pads 51 and 54 of the punch and detached from adjacent blanks 53 as it is first forced through the set of bars 17 and then bent and forced through the second set of bars 17′ at which time it is guided by the guides 49 into a pile 53' of blanks on a blank receiving receptacle schematically illustrated by 56. It is noted that the adjacent punch members 38 attached to one of the bar members such as 33 are spaced apart so that sufficient room is provided to receive the bar or member 17 of the matrix.

Figure 6:
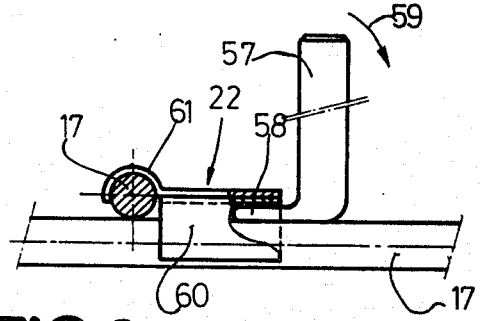
FIG. 6 is an enlarged side view of a removable fastening means in accordance with the present invention.
Figure 7:
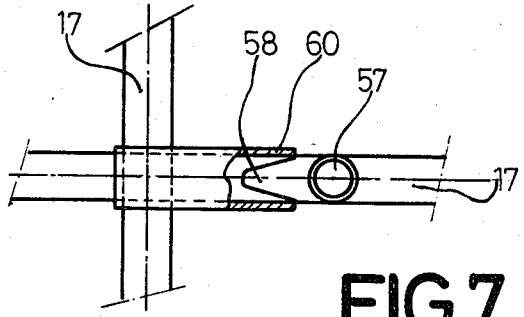
FIG. 7 is a plan view of the fastening means of FIG. 7.

As mentioned hereinbefore, each of the cross over points between the set 17 and 17' are interconnected by fastening means 22. As best illustrated in FIGS. 6 and 7, each of the fastening means 22 comprises a clip, which is removable by a tool 57 which has an end 58 which can be inserted in between the clip 22 and the bar 17 so that as the tool 57 is rotated in a direction 59, the clip is removed from the member 17. The member 22, as best illustrated, has a pair of spring legs or grasping portions 60 for grasping one of the bars such as 17 and has a hook portion 61 for engaging the bar of the other set such as 17.

Figure 9:
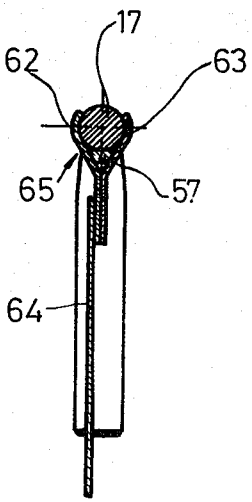
FIG. 9 is a cross-sectional view taken along lines IX—IX of FIG. 8.
Figure 8:
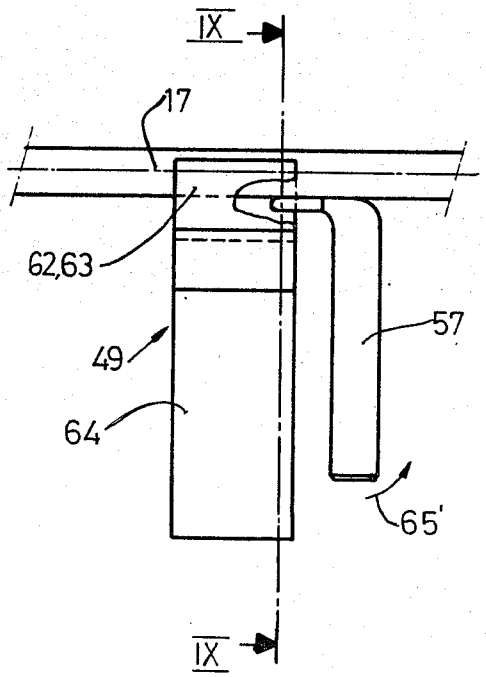
FIG. 8 is a side view of a blank guide in accordance with the present invention.

As best illustrated in FIGS. 8 and 9, each of the blank guides 49 is secured on one of the members such as bars 17. Each of the blank guides 49 consist of two blades 62, 63 which are welded together and are made of spring steel to form grasping portions or pinchers 65. A guide feather or portion 64, which may be made of a transparent Myler is secured such as by glue on a lower part of the pinchers 65. The blank guides 49 can also be dismantled by means of a tool such as 57, which has its end 58 inserted between the bar 17 and the pinchers 65 so that during pivoting in the direction of arrow 65', the guide 49 will be pulled from the member 17.

Due to the design of both the matrix and the punch, the user can easily change the position and size of the openings of the matrix and the components making up each of the punches so that the size and shape of both the punch and matrix can be changed to correspond to the size and shape of the blanks being processed. Thus, the adjustable punches and the matrix enables handling of different size blanks without requiring replacement of both the punches and matrix.

Although various minor modifications may be suggested by those versed in the art, it should be understood that I wish to embody within the scope of the patent warranted hereon, all such modifications as reasonably and properly come within the scope of my contribution to the art.

I claim:

1. In a device for stripping blanks from a die cut sheet of blanks, said device including a set of punches mounted on a punch frame and a matrix being supported on a support frame and having openings corresponding to the outlines of both the punches and blanks, one of said frames being movable relaive to the other so that the punches can extend into the openings of the matrix to force the blanks through the matrix openings to strip them from the sheet, the improvements comprising each of the punches of said set of punches comprising a plurality of punch members and means extending between adjacent punch members to close the outline of each punch, said punch members being adjustably mounted on a first set of bars supported on the punch frame and slidable therealong to vary the size of the outline of each punch, said matrix comprising a first set of parallel extending members, a second set of parallel extending members and a plurality of removable fastening means for interconnection, said support frame being rectangular with one set of parallel sides being at one level and second set of parallel sides being at a different level, said first set of parallel extending members being adjustably mounted on said first set of parallel sides and shiftable therealong to adjust the distance therebetween, said second set of parallel extending members being adjustably mounted on said second set of parallel sides to overlie and extend across the first set and being shiftable therealong to adjust the distance therebetween so that the size of the rectangular opening formed by adjacent parallel members of the first and second sets is adjustable, said removable fastening means being disposed at each cross over point between the first and second set for interconnecting the members together.

2. In a device according to claim 1, wherein each of said first set of bars are adjustably mounted on said punch frame so that the distance therebetween can be varied.

3. In a device according to claim 1, wherein each of the punch members has a rubber pad on a punching surface so that the punch member engages the blank with said rubber pad.

4. In a device according to claim 1, wherein the means for extending between adjacent punch members includes linking component secured on the punch member with the linking component of one punch member overlapping one of the adjacent punch members or a linking component attached thereto, said punch members and linking components being provided with a rubber pad on the edges directed toward the matrix so that a blank is engaged by the rubber pads as the punch strips it from the sheet.

5. In a device according to claim 1, wherein each of the parallel extending members for the first and second set of the matrix is a bar having a round cross section.

6. In a device according to claim 1, wherein each of the parallel extending members of the first and second sets forming the matrix has a rectangular cross section.

7. In a device according to claim 1, wherein the removable fastening means for interconnecting comprises a clip having a hook portion for engaging one of the extending members of one set and leg portions for grasping the member of the other set.

* * * * *